United States Patent [19]

Caplan

[11] 4,300,759

[45] Nov. 17, 1981

[54] INFLATABLE AQUATIC EXERCISER

[75] Inventor: David M. Caplan, Los Alamitos, Calif.

[73] Assignee: AMF Incorporated, White Plains, N.Y.

[21] Appl. No.: 136,149

[22] Filed: Mar. 31, 1980

[51] Int. Cl.[3] ..... A63B 31/00

[52] U.S. Cl. ..... 272/116; 128/DIG. 20; 272/130; 272/71; 273/DIG. 30

[58] Field of Search ..... 128/325, 327, DIG. 20, 128/297, 298, 299, DIG. 15, 680, 686; 272/71, 116, 119, 126, 130, 1 B, 76; 9/14, 301, 307, 308, 310 F, 311, 314, 316, 328, 329, 334, 335, 337, 340, 344, 400; 273/58 R

[56] References Cited

U.S. PATENT DOCUMENTS

| | | | |
|---|---|---|---|
| 373,692 | 11/1887 | Shaaber | 272/130 UX |
| 2,267,070 | 12/1941 | Baldwin | 128/DIG. 20 X |
| 2,693,794 | 11/1954 | Neville | 128/686 |
| 2,694,395 | 11/1954 | Brown | 128/DIG. 20 |
| 2,830,585 | 4/1958 | Weiss | 128/DIG. 20 |
| 2,943,859 | 7/1960 | Koski et al. | 128/327 X |
| 3,164,152 | 1/1965 | Vere Nicoll | 128/DIG. 20 |
| 3,185,476 | 5/1965 | Fechner | 272/76 X |
| 3,427,022 | 2/1969 | Ward | 273/58 R X |
| 3,752,148 | 8/1973 | Schmalzbach | 128/DIG. 20 X |
| 3,901,225 | 8/1975 | Sconce | 128/DIG. 20 X |
| 3,906,937 | 9/1975 | Aronson | 128/327 X |
| 3,977,393 | 8/1976 | Kovacic | 128/DIG. 15 X |
| 4,168,063 | 9/1979 | Rowland | 128/DIG. 20 X |

FOREIGN PATENT DOCUMENTS

| | | | |
|---|---|---|---|
| 440113 | 1/1927 | Fed. Rep. of Germany | 128/DIG. 20 |
| 1476696 | 3/1967 | France | 9/344 |
| 13630 | of 1911 | United Kingdom | 272/130 UX |

*Primary Examiner*—Richard C. Pinkham
*Assistant Examiner*—Arnold W. Kramer
*Attorney, Agent, or Firm*—George W. Price; Walter Lewis

[57] ABSTRACT

Multi-chambered air inflatable aquatic exercise jackets for the arms and legs constructed from plastic sheet material.

3 Claims, 4 Drawing Figures

INFLATABLE AQUATIC EXERCISER

This invention relates to an inflatable aquatic exerciser, and more particularly to a low cost inflatable aquatic exerciser for the limbs.

Briefly, in the invention double plastic sheet air inflatable jackets or sleeves are provided for the arms and legs to enable the user thereof to pleasantly exercise his limbs in water. These jackets or sleeves are not flotation devices, but assists to performing a multiplicity of aquatic exercises.

Figure 1:
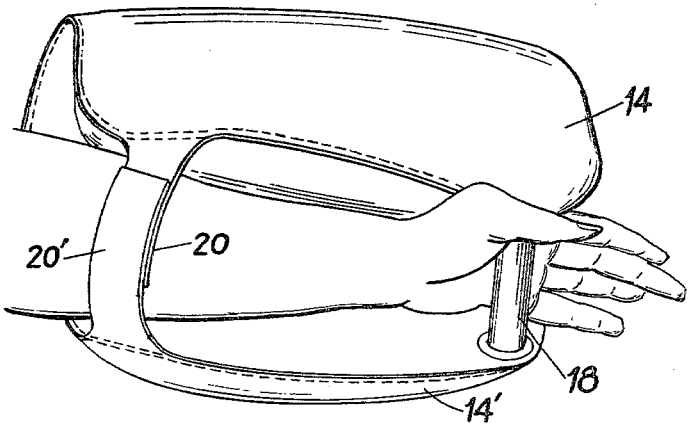
Figure 3:
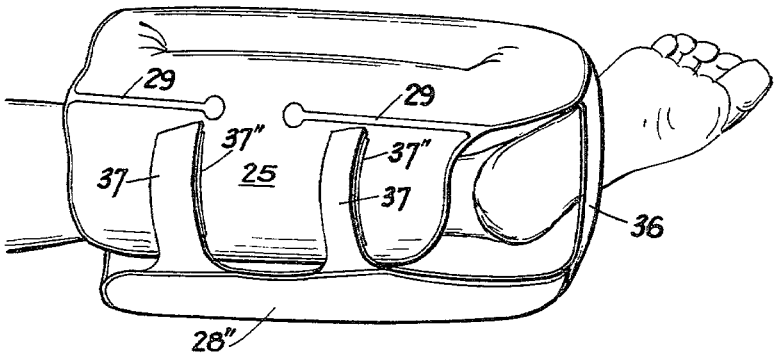
Figure 2:
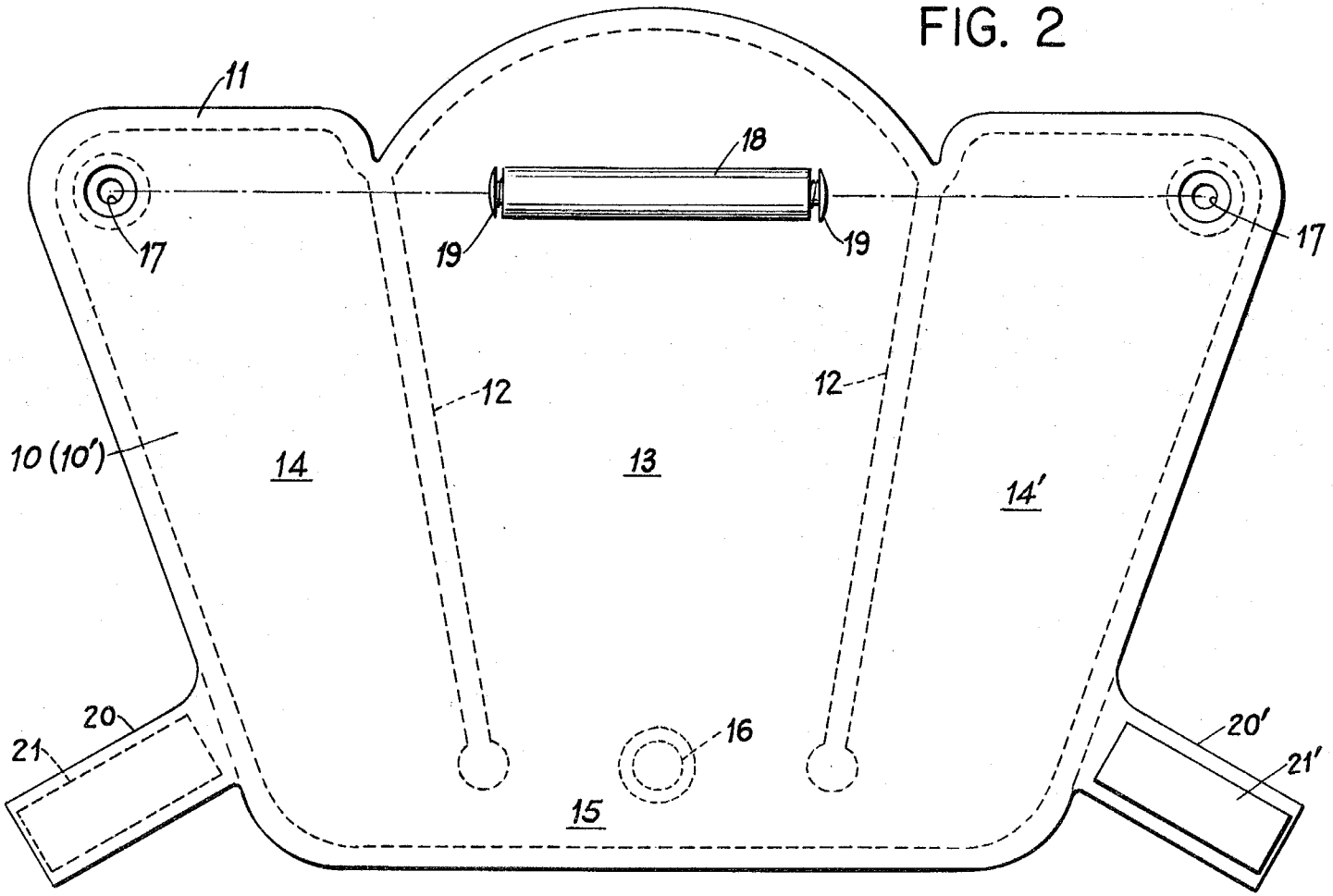
Figure 4:
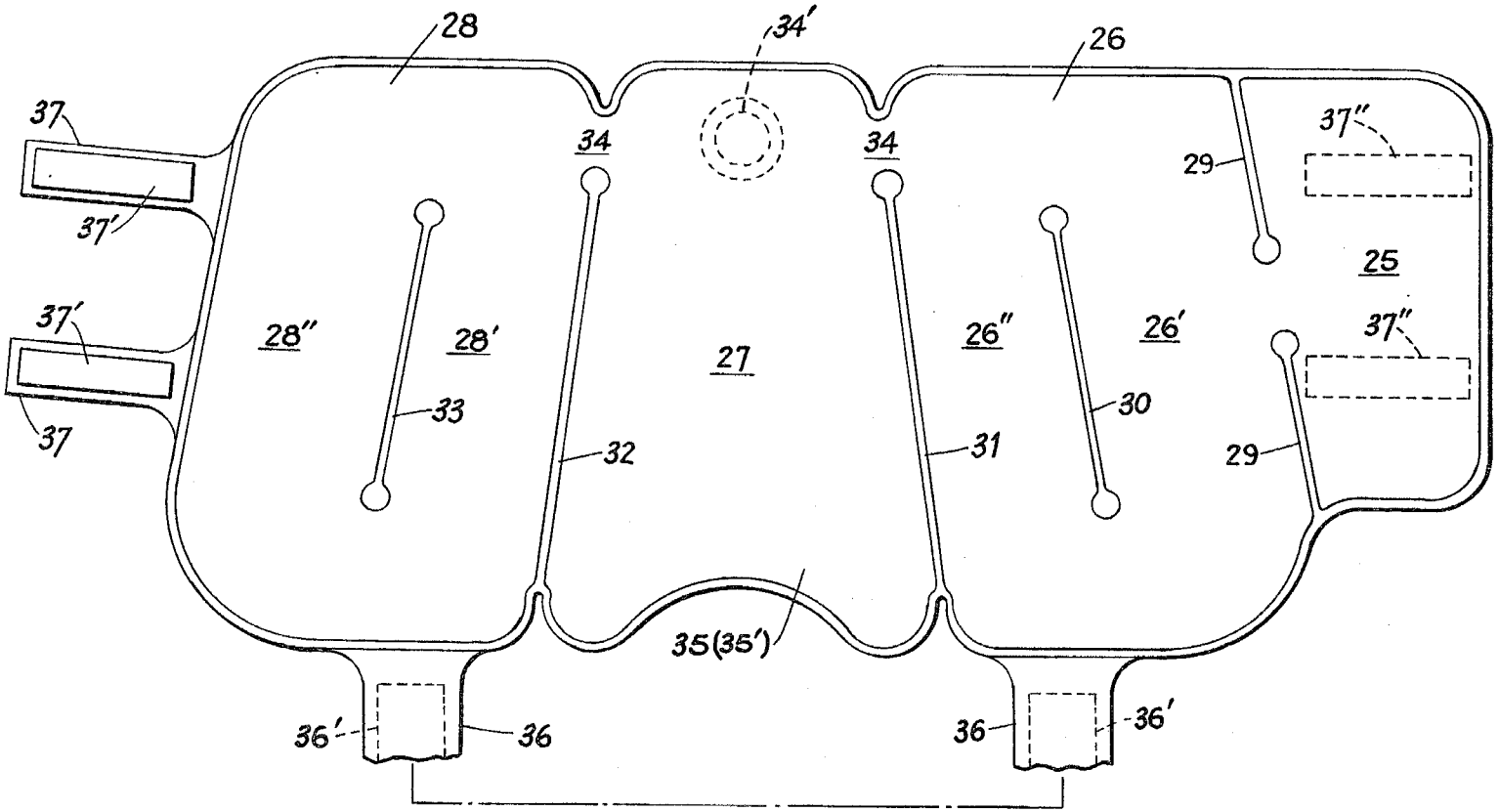

The invention will be best understood by considering the following detailed description of a commercial form thereof, taken in connection with the accompanying 3 sheets of drawings in which FIG. 1 is a view of the arm exerciser in use, FIG. 2 is a development view of the arm exerciser, FIG. 3 is a view of the leg exerciser in use, and FIG. 4 is a development view of the leg exerciser.

Referring now first to FIGS. 1 and 2 of the drawings, illustrated therein is the inflatable exerciser for the arms. As shown, the device comprises two identical sheets 10, 10' of plastic material which are heat sealed to each other along their outer edges 11. They are additionally provided with two lengthwise seams 12 which divide the device into three chambers 13, 14, 14'. These three chambers are in communication with each other since the seams 12 extend too short of the full length of the device. That is to say, the left hand end of the device comprises a common air manifold 15 for inflating all three chambers.

The chamber 13 is the central one, and 14 and 14' the two outer ones, the latter two being the same. The device is inflated at a valved opening 16 formed in the outer one 10' of the two sheets 10, 10' at the central portion of the manifold 15.

The right hand ends of the outer edges of the chambers 14, 14' have sealed aperatures 17 formed therein and a hand grip 18 is connected to the device by a pair of screws 19 which enter the opposite ends of the hand grip through the holes 17.

At their other ends the two side chambers are provided with tabs 20, 20' along their outer edge. These two tabs are provided with Velcro type fastening means 21, 21', but the fastening means could comprise snaps, clips or other appropriate means for closing one tab on the other. The Velcro type closure surface is formed on opposite sides of the tabs. That is to say on the inside of one tab (21' of 20' of 10) and the outside of the other (21 of 20 of 10').

As shown, in use the multicompartmented device covers the arm like a partial jacket or sleeve, the tabs 20, 20' being closed on each other, and the user's hand gripping the handle 18. The fit of the partial jacket or sleeve on the arm can be snug or loose depending upon the degree to which the device is inflated, however even at full inflation the device is not uncomfortable. The degree of inflation is also the means for varying the degree resistance (buoyancy) to exercise since when exercising with the arms the arms are in the water.

Referring now to FIGS. 3 and 4, shown therein is an exercise float for the other limbs, namely the legs. This device is constructed similar to the arm float exerciser except that instead of having just three main panels it has four 25–28 inclusive which in turn are subdivided into a plurality of chambers or channels 25, 26', 26'' 27, 28', 28'' by a plurality of heat seal formed seams 29, 30, 31, 32, 33. All the chambers or channels are in communication with each other and a common manifold 34 defined between the two sheets 35, 35' at the left hand end of the device since all the heat seal formed seams are discontinuous or extend for less than the full length of the device. A valved opening 34' to the manifold 34 is provided in the outer sheet 35' at the panel or chamber 27.

A short integral plastic sheet arch receiving strap or stirrup 36 interconnects the two panels 26 and 28. The interior of stirrup strap 36 has a mass of sponge material 36' therein to make the stirrup comfortable to the user's foot arch.

The outer edge of the panel 28 also has connected thereto two spaced integral fastening tabs 37, the insides of which are surfaced with suitable Velcro fastening material 37'. The outside of the panel 25 has complimentary Velcro material 37'' on it to cooperate with the tabs 37 so panels 25 and 28 meet or slightly overlap when the jacket or sleeve is on the leg, whereas in the arm float the two outer panels 14, 14' are spaced with respect to each other when that device is on the arm limb.

When using the exercise device a pair of arm and limb exercisers are provided in the packaged product, but it will be appreciated that the arms or legs can be exercised alone or any desired combination thereof, or all together at once. In laying out the two sheets and cutting them to size of course they are contoured so that when partially or fully inflated they will have a nice fit on the limbs. Besides being able to adjust the fit by the degree of inflation, adjustments can also be made at the fastening straps. The jackets can be made as long as desired, but in the commercial form thereof they surround the hand and forearm (below the elbow) and the ankle and calf (below the knee).

It will now be seen that my invention provides a low cost, minimum parts, safe and comfortable exerciser. In addition it is new in that it is an aquatic exerciser. By using floats on the limbs the forces of resistance to exercise can be increased beyond that normally encountered with bare limbs due to natural buoyancy, and further, by using inflatable flexible plastic sheeting it is possible to vary the degree of resistance to exercise by adjusting the amount to which the floats are inflated.

I claim:

1. An inflatable limb encircling aquatic exerciser jacket for exercising a limb in water, said aquatic jacket comprising two sheets of flexible plastic sheet material which are sealed together along their outer edges into a closed compartment, seams formed between said two sheets to subdivide said compartment into a manifold and a plurality of parallel channels which are in communication with each other and said manifold, a valved opening in one of said sheets for inflating said manifold and channels with air, said aquatic jacket when positioned on a human limb having said seams extending lengthwise thereof, fastening means on opposite sides of said aquatic jacket for retaining the same on said limb in a loose surrounding relationship, said aquatic jacket when on said limb surrounding the outer extremity thereof and progressing therefrom up said limb past the first joint thereof to just below the second joint thereof, and a narrow cross member at the lower end of said aquatic jacket, said cross member being spaced at its front edge and rear edge from the material of said jacket to permit engagement of said cross member by a hand for gripping thereof or by the central area of the underside of the wearer's foot.

2. In an inflatable limb encircling aquatic exerciser jacket as in claim 1, said cross member comprising a hand grip, and said channels comprising at least three in number extending lengthwise of an arm inserted into said jacket, said jacket surrounding the hand of said arm and progressing up the same towards below the elbow thereof.

3. In an inflatable limb encircling aquatic exerciser jacket as in claim 1, said cross member comprising an ankle stirrup, and said channels comprising at least four in number extending lengthwise of a leg inserted into said jacket, said exerciser surrounding the ankle of said leg and progressing up the same towards below the knee thereof.

* * * * *